United States Patent [19]

Ayton

[11] 3,995,394

[45] Dec. 7, 1976

[54] GROWTH-SIMULATING FIGURE TOY

[75] Inventor: Ian Frederick Ayton, Palos Verdes Estates, Calif.

[73] Assignee: Mattel, Inc., Hawthorne, Calif.

[22] Filed: Apr. 24, 1975

[21] Appl. No.: 571,330

[52] U.S. Cl. ..... 46/119

[51] Int. Cl.[2] ..... A63H 33/00

[58] Field of Search ..... 46/119, 162; 223/68

[56] References Cited

UNITED STATES PATENTS

| | | | |
|---|---|---|---|
| 1,081,313 | 12/1913 | Satin et al. | 223/68 |
| 1,153,633 | 9/1915 | Levin | 223/68 |
| 2,273,743 | 2/1942 | Weinstein | 223/68 |
| 2,669,063 | 2/1954 | Lang | 46/119 |
| 2,741,870 | 4/1956 | Lang | 46/119 |
| 3,731,426 | 5/1973 | Lewis et al. | 46/119 |

*Primary Examiner*—F. Barry Shay

*Attorney, Agent, or Firm*—Max E. Shirk; Stephen L. King; John M. May

[57] ABSTRACT

Lower torso member includes a waist member having a lower portion and an upper portion so that pliable, rubber-like upper torso waist member may be slid from lower portion of lower torso waist member where it simulates waist of pre-teenager to upper portion of lower torso waist member where it simulates waist of a teenager while simulated breasts are simultaneously pressed outwardly against upper torso member causing bulging of the rubber-like material to form a simulated bustline.

3 Claims, 6 Drawing Figures

4
51
50
142
60
144
136
104
134
52
132
130
86
86
6
48
64
112
10
100
46
62
70
44
112
109
118
126
42
96
98
128
54
124
68
120
94
102
106
6
122
38
80
82
74
140
78
72
138
26
30
76
22
28
18
58
24
40
32
12
34
56
20
4

10
60
50
51
146
144
86
112
64
132
136
106
129
52
38
54
78
128
54
70
82
140
26
74
22
28
76
30
40
58
24
18
12
32
34
14
56
16
36
20

112
114
118
116

120
122
96
70

GROWTH-SIMULATING FIGURE TOY

BACKGROUND OF THE INVENTION

The background of the invention will be set forth in two parts.

1. Field of the Invention

The present invention pertains generally to the field of so-called "growing" figure toys and more particularly to a new and useful growth-simulating figure toy which may be manipulated to simulate growth from a pre-teenage female to a teenage female.

2. Description of the Prior Art

The prior art known to applicant is listed by way of illustration, but not of limitation, in separate communications to the U.S. Patent Office.

Among this prior art are U.S. Pats. Nos. 2,741,870 and 3,731,426 owned by the assignee of the instant application.

U.S. Pat. No. 2,741,870 discloses a growing figure toy including a one-piece expansible and contractible covering. The figure toy contains a mechanism operative to expand the figure toy from a normal condition in both longitudinal and transverse directions for simulating animate growth. The mechanism is contractible for restoring the figure toy to normal position after an expanding operation.

U.S. Pat. No. 3,731,426 discloses a shape-changing figure toy which includes a shape-changing member normally disposed beneath a flexible covering material in a non-material bulging position. Means are connected to the shape-changing member for swinging it outwardly into a material-bulging position so that the shape of the figure toy is changed in a selected area.

The assignee of the instant application is also the assignee of copending application Ser. No. 558,764 filed Mar. 17, 1975. This copending application discloses a growth-simulating figure toy of the type herein disclosed.

OBJECTS AND SUMMARY OF THE INVENTION:

It is a primary object of the present invention to provide a new and useful growth-simulating figure toy exemplifying improvements over prior art figure toys of the types disclosed in U.S. Pats. Nos. 2,741,870 and 3,731,426 and of the type disclosed in copending application Ser. No. 558,764, filed Mar. 17, 1975.

It is another object of the present invention to provide a new and useful growth-simulating figure toy which simulates the growth of a female from a pre-teenager to a teenager.

According to the present invention, a growth-simulating figure toy is provided and includes a lower torso member including a waist member having a lower portion of a first predetermined girth and an upper portion of a second predetermined girth less than the first predetermined girth.

A pliable, rubber-like upper torso member has a waist member slidably mounted on the lower torso waist member with the upper torso waist member conforming to the shape and girth of the lower torso waist member regardless of the location of the upper torso waist member with respect to the upper and lower portions of the lower torso waist member so that the upper torso waist member will simulate the pudgy waist of a pre-teenager when the upper torso waist member is in position on the lower portion of the lower torso waist member and will simulate the trim waist of a teenager when the upper torso waist member is in position on the upper portion of the lower torso waist member.

A new and useful connecting means is connected to the upper torso member for moving the upper torso waist member from one position to another position on the lower torso waist member.

The connecting means includes a support bracket having a hollow, cylindrical portion seated in the lower torso member and a pair of upstanding flanges. Each flange carries a bearing at its upper end adjacent a shoulder opening in the upper torso member.

The connecting means also includes a crank having a journal rotatably mounted in each flange bearing and a crank pin extending from each end of the crank into each shoulder opening. Another crank pin is provided on the crank intermediate its ends.

The connecting means also includes an actuator bar having a lower end slidably mounted in the cylindrical portion of the support bracket, an upper end connected to the neck portion of the upper torso member and a slotted intermediate portion rotatably receiving the intermediate crank pin which raises and lowers the actuator bar when the crank is rotated. A bushing is rotatably mounted on each of the crank pins extending from the ends of the crank. One or both of these bushings may be affixed to the arms of the figure toy for rotation thereby. Fingers on the bushings engage L-shaped fingers on the crank to impart rotation thereto. The bushings are mounted in the shoulder openings in such a manner that the crank pins will raise and lower the shoulders of the figure toy when the crank is rotated.

The figure toy also includes a pair of simulated breasts which are swingably mounted on the actuator bar and which include camming means engageable by the crank for swinging the simulated breasts into bulging engagement with the upper torso member when the actuator bar is raised.

The features of the present invention which are believed to be novel are set forth with particularity in the appended claims. The present invention, both as to its organization and manner of use, together with further objects and advantages thereof, may best be understood by reference to the following description, taken in connection with the accompanying drawings in which like reference characters refer to like elements in the several views.

DESCRIPTION OF THE PREFERRED EMBODIMENT

Figure 1:
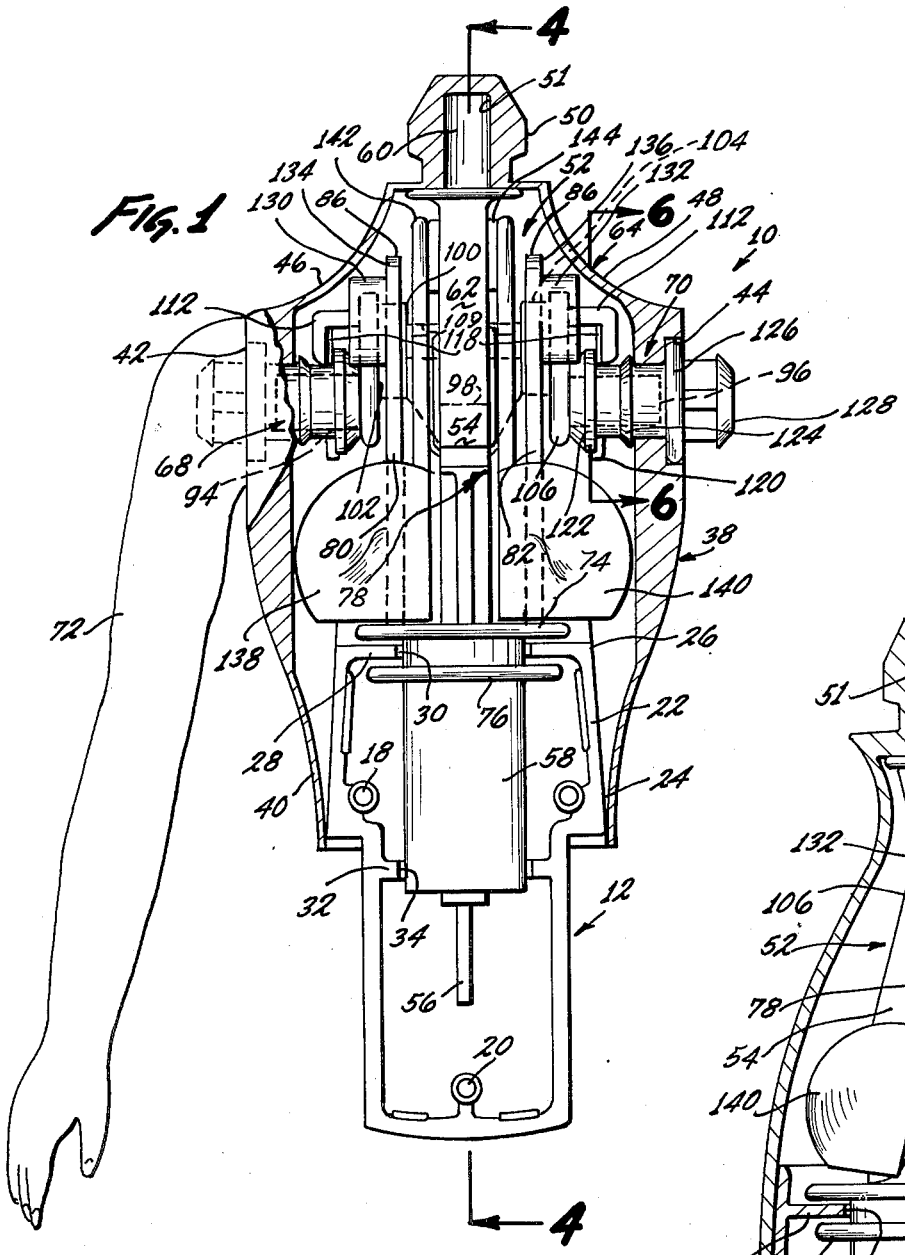
FIG. 1 is a partial front elevational view, with parts broken away to show internal construction, of a growth-simulating figure toy of the present invention showing the relative position of the toy mechanism before it has been manipulated to simulate growth.
Figure 2:
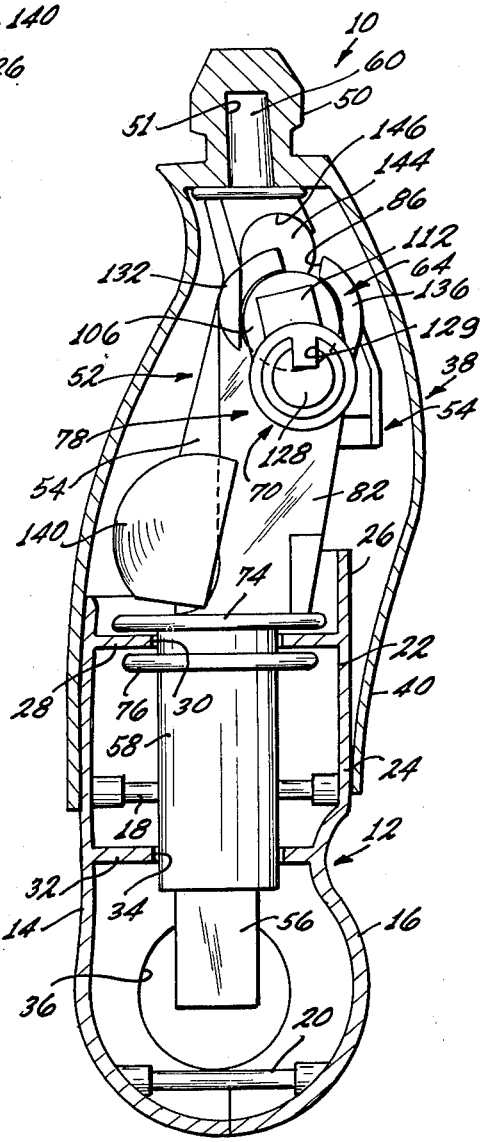
FIG. 2 is a partial, side elevational view with parts shown in cross section, of the figure toy of FIG. 1.
Figure 6:
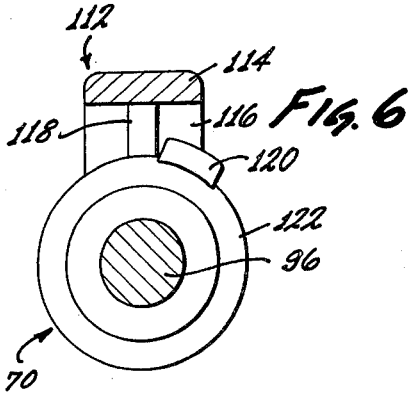
FIG. 6 is an enlarged, cross-sectional view taken along line 6—6 of FIG. 1.

Referring again to the drawings, and more particularly to FIGS. 1 and 2, a growth-simulating figure toy constituting a presently preferred embodiment of the invention, generally designated 10, includes a lower torso member 12 made of a fairly rigid plastic material molded to form a front half 14 and a rear half 16 which may be connected together by suitable pins, like the ones shown at 18 and 20. Lower torso member 12 includes a waist member 22 having a lower portion 24 of a first predetermined girth and an upper portion 26 of a second predetermined girth less than said first predetermined girth. Lower torso member 12 also includes an upper partition 28 provided with an opening 30 and a lower partition 32 provided with an opening 34. Lower torso member 12 may be provided with suitable leg openings, like the one shown at 36, for the reception of legs (not shown).

Figure toy 10 also includes a pliable, rubber-like upper torso member 38 having a waist member 40 slidably mounted on lower torso waist member 22 with the upper torso waist member 40 conforming to the shape and girth of the lower torso waist member 22 regardless of the location of the upper torso waist member 40 with respect to the lower and upper portions 24, 26 of the lower torso waist member 22 so that the upper torso waist member 40 will simulate the pudgy waist of a pre-teenager when the upper torso waist member 40 is in position on the lower portion 24 of the lower torso waist member 22 and will simulate the trim waist of a teenager when the upper torso waist member 40 is in position on the upper portion 26 of the lower torso waist member 22. The upper torso member 38 also includes a pair of shoulder openings 42, 44 from which shoulders 46, 48, respectively, slope upwardly to a neck plug 50 having a counterbore 51 provided therein.

Figure toy 10 also includes a connecting means 52 which is connected to the upper torso member 38 for moving the upper torso waist member 40 from one position to another position on the lower torso waist member 22 and for elevating shoulders 46, 48. Connecting means 52 comprises an actuator bar 54, having a lower end 56 slidably mounted in a cylindrical member 58 provided in lower torso member 12, an upper end 60 seated in counterbore 51 and an intermediate portion 62; a crank means 64 connected to a slot 66 (FIGS. 4 and 5) on intermediate portion 62 of actuator bar 54 for raising and lowering actuator bar 54 when crank means 64 is rotated; a pair of bushings 68, 70 extending through shoulder openings 42, 44, respectively; and a suitable lever means, such as one of the doll arms 72, connected to bushing 68.

The cylindrical member 58 extends through the holes 30, 34 in partitions 28, 32, respectively, and is maintained in position therein by a pair of spaced, annular collars 74, 76 positioned above and below partition 28, respectively. Cylindrical member 58 forms the lower end of a bracket 78 having a pair of upstanding flanges or arms 80, 82 extending from cylindrical member 58 to the vicinity of shoulders 46, 48. The arms 80, 82 are connected together near their lower ends by a bracket 84 (FIGS. 4 and 5) and are provided with U-shaped bearings 86 at their upper ends.

Figure 3:
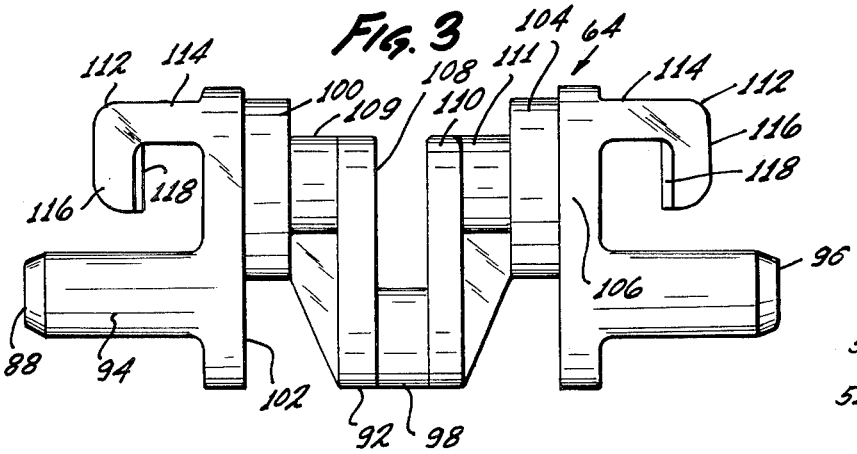
FIG. 3 is an enlarged perspective view of a crank used in the figure toy of FIG. 1.

Referring now to FIG. 3, crank means 64 includes a first end 88, a second end 90 and an intermediate portion 92 provided with crank pins 94, 96, and 98, respectively. Crank pin 94 is connected to a first crank journal 100 by a first web 102; crank pin 96 is connected to a second crank journal 104 by a second web 106 and crank pin 98 is connected to the first crank journal 100 by a third web 108 and a cam 109 and to the second crank journal 104 by a fourth web 110 and a cam 111. An L-shaped bracket 112 is affixed to each web 102, 106. Each bracket 112 includes a first leg 114 extending outwardly over an associated one of the pins 94, 96 substantially parallel thereto and a second leg 116 depending downwardly from the outboard end of its associated first leg 114. Each leg 116 carries a detent 118 engageable by a protuberance 120 provided on each bushing 68, 70 (FIG. 1) for imparting rotation to crank means 64 when either bushing 68, 70 is rotated.

Referring now to FIGS. 1–6, crank journals 100, 104 are rotatably mounted in bearings 86. Crank pin 98 is seated in slot 66 on actuator bar 54 for reciprocating it when crank means 64 is rotated. Crank pins 94, 96 extend into shoulder openings 42, 44, respectively, and receive bushings 68, 70, respectively, for raising and lowering shoulders 46, 48 when crank means 64 is rotated. Bushings 68, 70 each includes an inner, annular flange 122 engageable with an associated one of the brackets 112 for retaining the bushings in position on their crank pins. Each bushing also includes a pair of shoulders 124, 126 trapping the pliable material forming the shoulder openings 42, 44 in upper torso member 38. Each arm of figure toy 10 may be connected to an associated one of the bushings 68, 70 for imparting rotation thereto by molding the arm onto a plug 128 provided on the outboard end of each bushing 68, 70. Each plug 128 is provided with a notch, as shown at 129 in FIG. 2 for the bushing 70. A key (not shown) is provided on each arm of the figure toy for both locking the arms to the bushings and for properly orienting the arms with respect to crank pins 94, 96.

Rotation of crank means 64 is limited to about 180° by a pair of stop members 130, 132 (FIG. 1) affixed to the upper ends 134, 136 of arms 80, 82, respectively, on bracket 78. The stop members 130, 132 lie in the path-of-travel of crank webs 102, 106 and are located such that crank pins 94, 96 may rotate rearwardly from botton-dead-center to top-dead-center and back down again. However, bushings 68, 70 may be rotated 360° because protuberances 120 will slip past detents 118 when additional rotating force is applied to bushings 68, 70 after webs 102, 106 bottom out on stop members 130, 132, respectively.

Figure toy 10 may also include a pair of simulated breasts 138, 140 which may be swingably mounted in upper torso member 38 by a yoke 152 formed integrally with simulated breasts 138, 140 and with a transverse shaft 144. A notch 146 is provided in actuator bar 54 above notch 66 for rotatably receiving shaft 144 so that simulated breasts 138, 140 will move along with actuator bar 54 and travel from the lower position shown in FIG. 4 to the upper position shown in FIG. 5. Additionally, cams 109, 111 engage yoke 142 for swinging simulated breasts 138, 140 into bulging engagement with the upper torso member 38 when crank pin 98 raises actuator bar 54.

Figure 4:
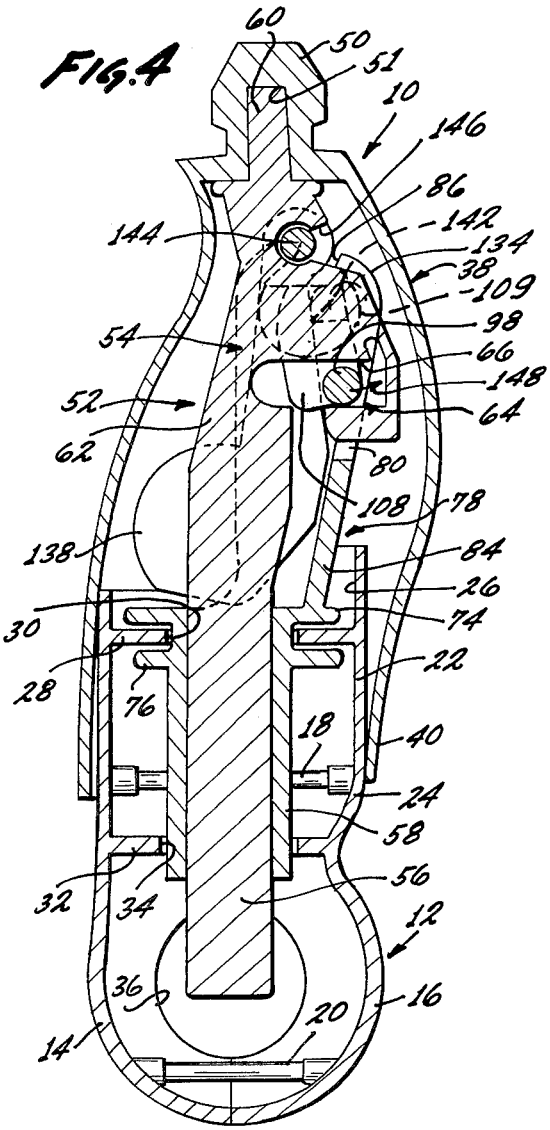
FIG. 4 is a cross-sectional view taken along line 4—4 of FIG. 1.
Figure 5:
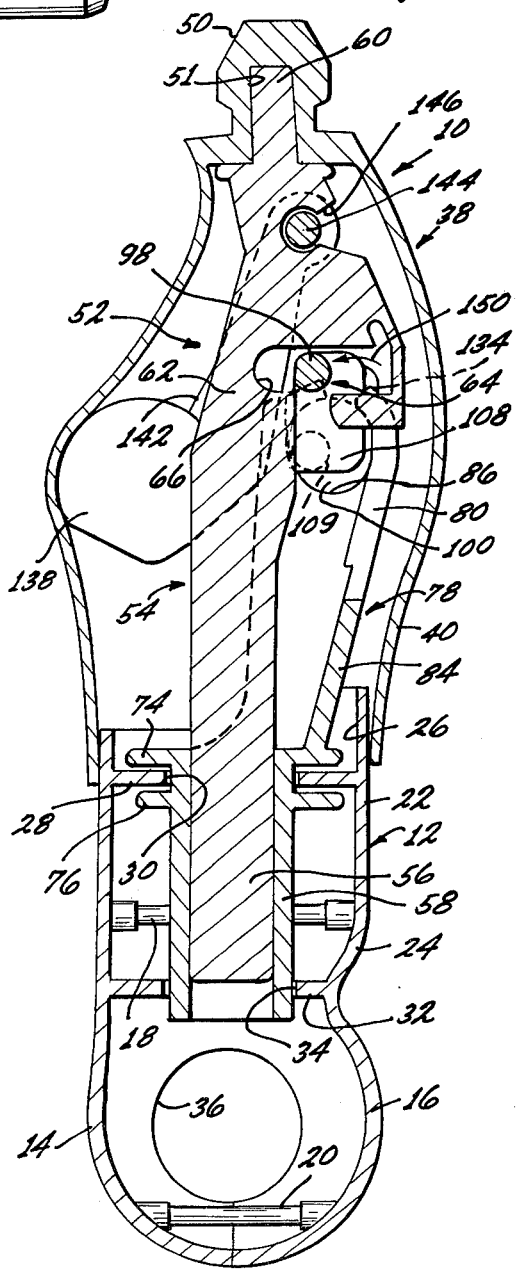
FIG. 5 is a view similar to FIG. 4, but showing the mechanism after it has been manipulated to simulate growth.

In use, it may be assumed that the parts have the relative positions shown in FIGS. 1, 2 and 4. A child-user may then simulate growth in figure toy 10 by rotating arm 72 backwards (as viewed in FIG. 1) approximately one full turn. During about the first one-half turn, protuberance 120 moves from a position approximately 180° out of phase with detent 118 to a position immediately behind detent 118 and in contact therewith. During the second one-half turn, protuberance 120 rotates crank means 64 counterclockwise (as viewed in FIGS. 2 and 4) swinging crank pin 98 along the path defined by arrows 148, 150 from the position shown in FIG. 4 to the position shown in FIG. 5. Crank pin 98 moves actuator bar 54 upwardly and crank pins 94, 96 move shoulders 46, 48 upwardly. This moves upper torso waist member 40 from the position shown in FIGS. 1, 2 and 4, where waist member 40 conforms to the lower (enlarged) portion 24 of waist member 22 for simulating a pudgy pre-teenager, to the position shown in FIG. 5 where waist member 40 conforms to the upper (reduced) portion 26 of waist member 22 for simulating the trim waist of a teenager. Simultaneously, actuator bar 54 moves simulated breasts 138, 140 upwardly while cams 109, 111 move them outwardly from the position shown in FIGS. 2 and 4 to the position shown in FIG. 5 where simulated breasts 138, 140 press the flexible material of torso member 38 outwardly forming a bustline therein. Arm 72 may then be rotated in the opposite direction to return figure toy 10 to its FIG. 4 position. Continued rotation of arm 72 after the figure toy parts have been moved to either the FIG. 4 position of the FIG. 5 position causes protuberance 120 to slip past detent 118 because webs 102, 106 are bottomed out on stops 130, 132.

While the particular growth-simulating figure toy herein shown and described in detail is fully capable of attaining the objects and providing the advantages hereinbefore stated, it is to be understood that it is merely illustrative of the presently preferred embodiment of the invention and that no limitations are intended to the details of construction or design herein shown other than as defined in the appended claims which form a part of this disclosure.

Whenever the term "means" is employed in these claims, this term is to be interpreted as defining the corresponding structure illustrated and described in this specification or the equivalent of the same.

What is claimed is:

1. In combination with a growth-simulating figure toy comprising a lower torso member including a waist member having a lower portion of a first predetermined girth and an upper portion of a second predetermined girth less than said first predetermined girth; a pliable rubber-like upper torso member having a neck portion, and a pair of shoulder openings and a waist member, said upper torso waist member being slidably mounted on said lower torso waist member, said upper torso waist member conforming to the shape and girth of said lower torso waist member regardless of the location of said upper torso waist member with respect to said upper and lower portions of said lower torso waist member, whereby said upper torso waist member will simulate the pudgy waist of a pre-teenager when said upper torso waist member is in position on said lower portion of said lower torso waist member and will simulate the trim waist of a teenager when said upper torso waist member is in position on said upper portion of said lower torso waist member; and means connected to said upper and lower torso members for moving said upper torso waist member from one position to another position on said lower torso waist member, the improvement wherein said means connected to said upper torso member comprises:

a support bracket mounted in said lower torso member, said support bracket including a first bearing member positioned adjacent one of said shoulder openings and a second bearing member positioned adjacent the other of said shoulder openings;

a crank having a first journal rotatably mounted in said first bearing member, a second journal rotatably mounted in said second bearing member, a first crank pin extending into said one shoulder opening, a first web connecting said first crank pin to said first journal, a second crank pin extending into said other shoulder opening, a second web connecting said second crank pin to said second journal, a third crank pin, a third web connecting said third crank pin to said first journal and a fourth web connecting said third crank pin to said second journal;

an actuator bar having a lower end reciprocably mounted in said support bracket in said lower torso member, an upper end connected to said upper torso neck portion and an intermediate portion lying adjacent a plane passing transversely of the figure-toy long axis and containing the axis through said shoulder openings, said intermediate portion being provided with a transverse slot, said third crank pin being mounted in said transverse slot, whereby said third crank pin will raise and lower said actuator bar and said first and second crank pins will raise and lower said shoulder openings of said upper torso member relative to said support bracket when said crank is rotated; and means connected to said crank for imparting rotation thereto.

2. An improvement as stated in claim 1 wherein said actuator bar is provided with a second transverse slot between said intermediate portion and said upper end and wherein said means connected to said upper torso member includes:

a pair of simulated breasts swingably mounted in said second transverse slot; and cam means carried by said crank adjacent said simulated breasts for swinging said simulated breasts into bulging engagement with said upper torso member when said crank is rotated to raise said actuator bar.

3. An improvement as stated in claim 1 wherein said figure toy includes at least one arm and wherein said crankrotation-imparting means is said arm.

* * * * *